US008851931B2

(12) United States Patent
Pan et al.

(10) Patent No.: US 8,851,931 B2
(45) Date of Patent: Oct. 7, 2014

(54) ELECTRICAL CONNECTOR WITH SOLDERING SECTIONS OF CONTACTS EXPOSED ON A SINGLE SIDE

(71) Applicant: Shenzhen Luxshare Precision Industry Co., Ltd., Shenzhen (CN)

(72) Inventors: Liang-Chen Pan, Kunshan (CN); Lin Wu, Kunshan (CN)

(73) Assignee: Luxshare Precision Industry Co., Ltd., Shenzhen, Guangdong Province (CN)

( * ) Notice: Subject to any disclaimer, the term of this patent is extended or adjusted under 35 U.S.C. 154(b) by 12 days.

(21) Appl. No.: 13/662,476

(22) Filed: Oct. 27, 2012

(65) Prior Publication Data

US 2013/0115822 A1 May 9, 2013

(30) Foreign Application Priority Data

Nov. 7, 2011 (CN) ..... 2011 2 0436260 U

(51) Int. Cl.
*H01R 24/00* (2011.01)
*H01R 33/00* (2006.01)
*H01R 12/50* (2011.01)

(52) U.S. Cl.
CPC ..... *H01R 23/7073* (2013.01)
USPC ..... 439/660; 439/607.49

(58) Field of Classification Search
CPC .. H01R 23/7073; H01R 23/02; H01R 13/658; H01R 12/775
USPC ..... 439/660, 607.49, 607.23, 607.24, 439/607.55
See application file for complete search history.

(56) References Cited

U.S. PATENT DOCUMENTS

| | | | | |
|---|---|---|---|---|
| 7,563,140 | B1 * | 7/2009 | Wan et al. | 439/660 |
| 7,625,243 | B2 * | 12/2009 | Chen et al. | 439/660 |
| 7,850,465 | B1 * | 12/2010 | Wan et al. | 439/79 |
| 7,942,704 | B2 * | 5/2011 | Ko et al. | 439/660 |
| 7,988,495 | B2 * | 8/2011 | Chung | 439/660 |
| 8,172,585 | B2 * | 5/2012 | Chiu et al. | 439/108 |
| 8,292,671 | B2 * | 10/2012 | Chung | 439/660 |
| 8,500,494 | B2 * | 8/2013 | Wu | 439/660 |
| 2011/0070778 | A1 * | 3/2011 | Wan et al. | 439/660 |
| 2011/0269322 | A1 * | 11/2011 | He et al. | 439/78 |
| 2011/0269341 | A1 * | 11/2011 | He et al. | 439/607.01 |

* cited by examiner

*Primary Examiner* — Hae Moon Hyeon
(74) *Attorney, Agent, or Firm* — Cheng-Ju Chiang

(57) ABSTRACT

A plug connector compatible to type-A USB 3.0 standard includes an insulative housing having a supporting portion, and a number of contacts divided into a first contact group and a second contact group on the insulative housing. The first contact group includes a number of first contacts compatible to USB 2.0 standard. The second contact group includes a number of second contacts compatible to USB 3.0 standard together with the first contacts. Each first contact and each second contact includes a flat first soldering section and a flat second soldering section, respectively. The flat first soldering sections and the flat second soldering sections are supported by and exposed on a single side of the supporting portion. As a result, cables can be easily and simultaneously soldered to the first and the second soldering sections for improving assembling efficiency.

20 Claims, 7 Drawing Sheets

ELECTRICAL CONNECTOR WITH SOLDERING SECTIONS OF CONTACTS EXPOSED ON A SINGLE SIDE

BACKGROUND OF THE INVENTION

1. Field of the Invention

The present invention relates to an electrical connector, and more particularly, to a plug connector compatible to USB 3.0 standard.

2. Description of Related Art

On November 2008, a new generation of USB 3.0 (super high-speed USB) enacted by industry-leading corporations including Intel, Microsoft, HP, TI, NEC and ST-NXP etc. was released. The USB 3.0 standard provides transmission speed 10 times quicker than the USB 2.0 standard and has higher energy efficiency so that the USB 3.0 standard can be applied in PC peripheral devices and consumer electronics.

The development of the USB (Universal Serial Bus) standards is as follows: the first version, known as USB 1.0, was released on 1996 and its transmission speed is only up to 1.5 Mb/s; two years later, the USB 1.0 was upgraded to USB 1.1 with its transmission speed to 12 Mb/s; on April 2000, current widely used USB 2.0 was released with its transmission speed up to 480 Mb/s; however, the speed of USB 2.0 cannot meet the requirements of actual use anymore and under this condition, the USB 3.0 was pushed forward and the maximum transmission speed thereof is up to 5.0 Gb/s.

The USB 3.0 standard (or specification) defines type-A receptacle and plug and the type-A USB 3.0 plug is compatible to USB 2.0 receptacle. Comparing with the preceding generation of type-A USB 2.0 plug, the type-A USB 3.0 plug newly adds five elastic contacts and totally has nine contacts. The newly added five contacts include two pairs of high-speed differential signal contacts and a grounding contact therebetween. The afore-mentioned nine contacts extend to a rear end of an insulative housing for being soldered to cables. Since the space of the insulative housing is very limited, normally, soldering sections of the nine contacts are arranged in two horizontal lines. During soldering process, the cables should be aligned with the soldering sections before soldering. Under this condition, it is possible that the cables get warped which is harmful to improve product efficiency and reduce cost.

Hence, an electrical connector with improved arrangement of soldering sections for quick soldering is desired.

BRIEF SUMMARY OF THE INVENTION

The present invention provides a plug connector compatible to type-A USB 3.0 standard. The plug connector includes an insulative housing and a plurality of contacts retained in the insulative housing. The insulative housing includes a mating portion and a supporting portion. The plurality of contacts are divided into a first contact group and a second contact group. The first contact group includes a plurality of first contacts each of which includes a rigid first contacting section extending onto the mating portion, a first retaining section fixed in the insulative housing and a flat first soldering section. The first contacts include a power contact, a first signal contact, a second signal contact and a first grounding contact. The second contact group includes a plurality of second contacts each of which includes a resilient second contacting section protruding upwardly beyond the mating portion, a second retaining section fixed in the insulative housing and a flat second soldering section. The second contacts include a first pair of high-speed differential signal contacts, a second pair of high-speed differential signal contacts and a second grounding contact disposed between the first pair and the second pair of high-speed differential signal contacts. The flat first soldering sections and the flat second soldering sections are supported by and exposed on a single side of the supporting portion. As a result, cables can be easily and simultaneously soldered to the first and the second soldering sections for improving assembling efficiency.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENT

Figure 1:
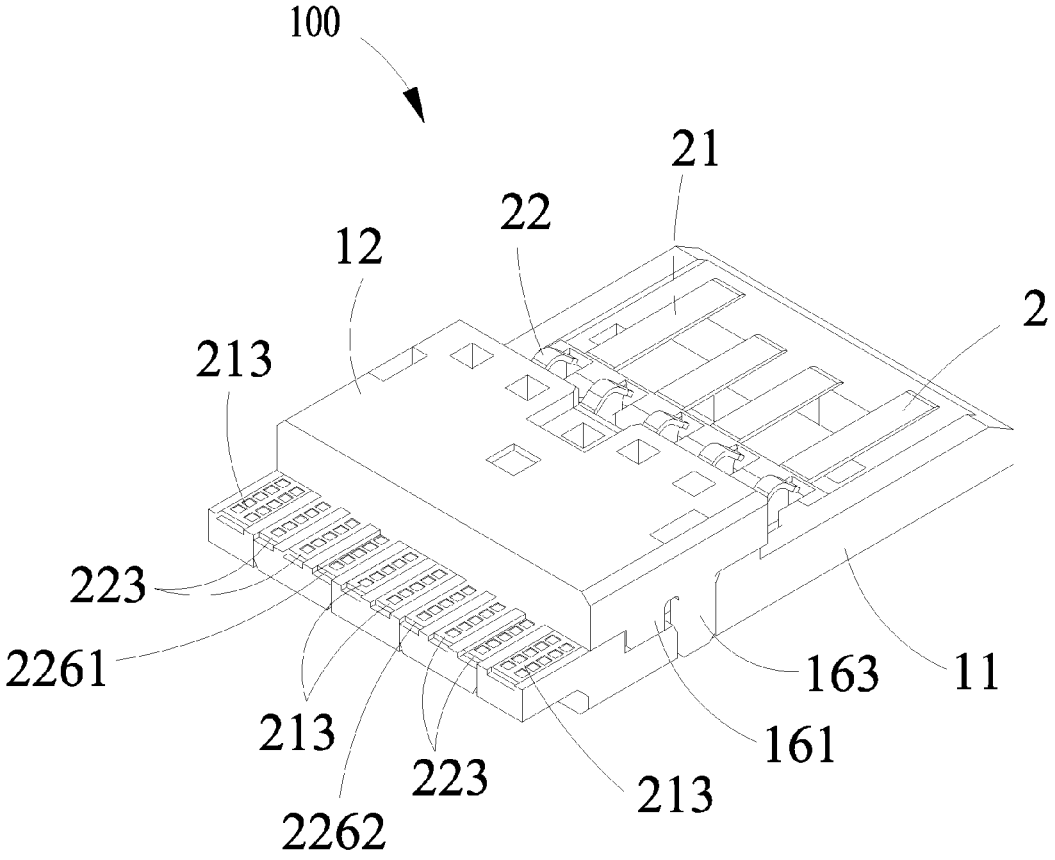
FIG. 1 is a perspective view of an electrical connector in accordance with an illustrated embodiment of the present invention.

Reference will now be made to the drawing figures to describe the embodiments of the present invention in detail. In the following description, the same drawing reference numerals are used for the same elements in different drawings.

Referring to FIGS. 1 to 5, the present invention discloses an electrical connector 100 compatible to type-A USB 3.0 standard. According to the illustrated embodiment of the present invention, the electrical connector 100 is a plug connector applied to USB 3.0 cable assembles or mobile storage devices (e.g. U-disk). The electrical connector 100 includes an insulative housing 1 and a plurality of contacts 2 retained in the insulative housing 1. Understandably, a metallic shell (not shown) can be employed to be fixed to and enclosing the insulative housing 1.

Figure 4:
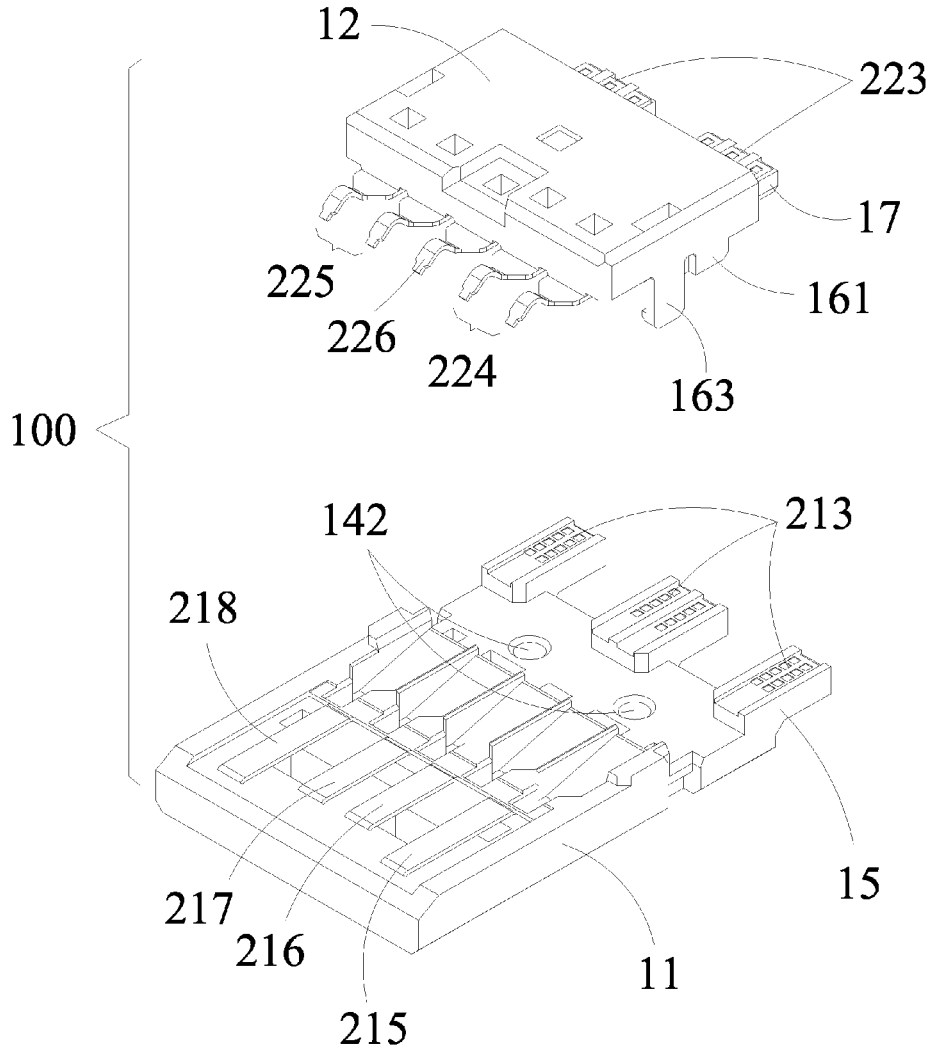
FIG. 4 is a partly exploded view of the electrical connector as shown in FIG. 1 with a first housing and a second housing separated from each other.
Figure 5:
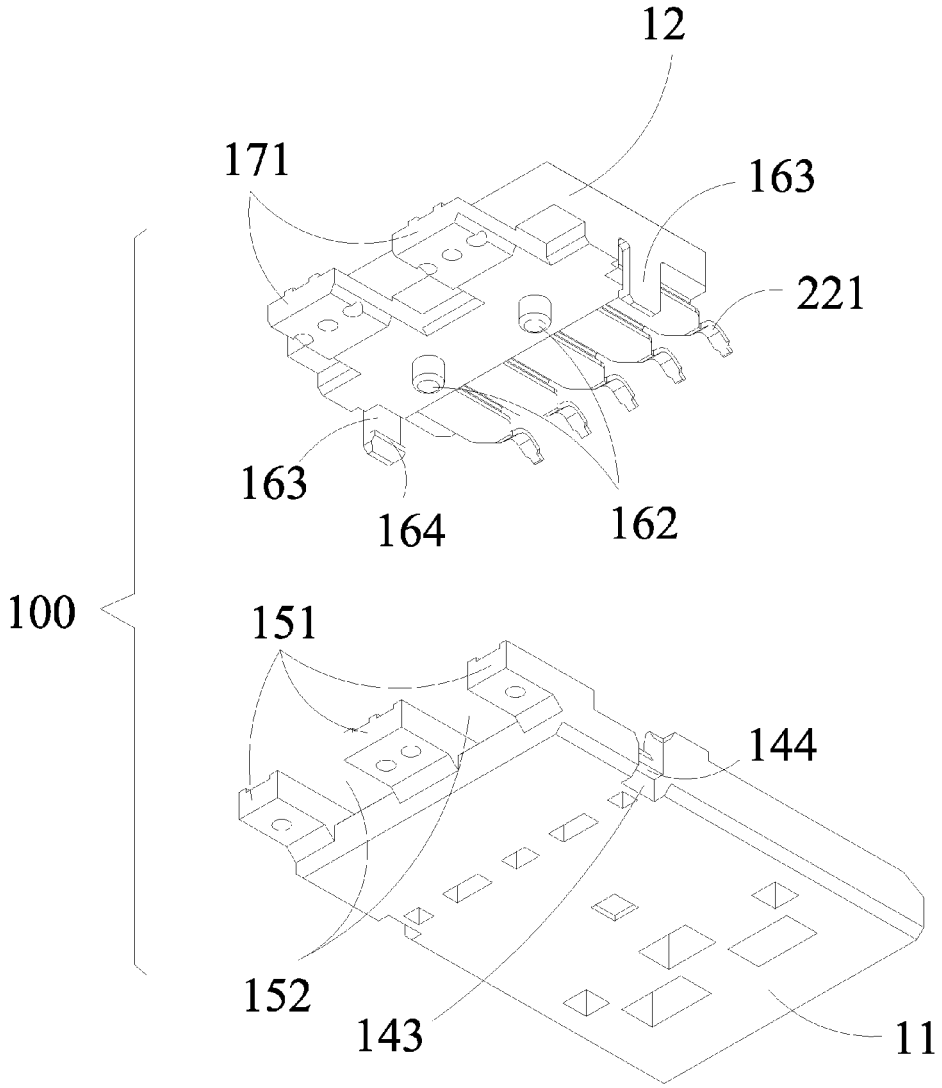
FIG. 5 is another partly exploded view of the electrical connector as shown in FIG. 4 while taken from a different aspect.
Figure 6:
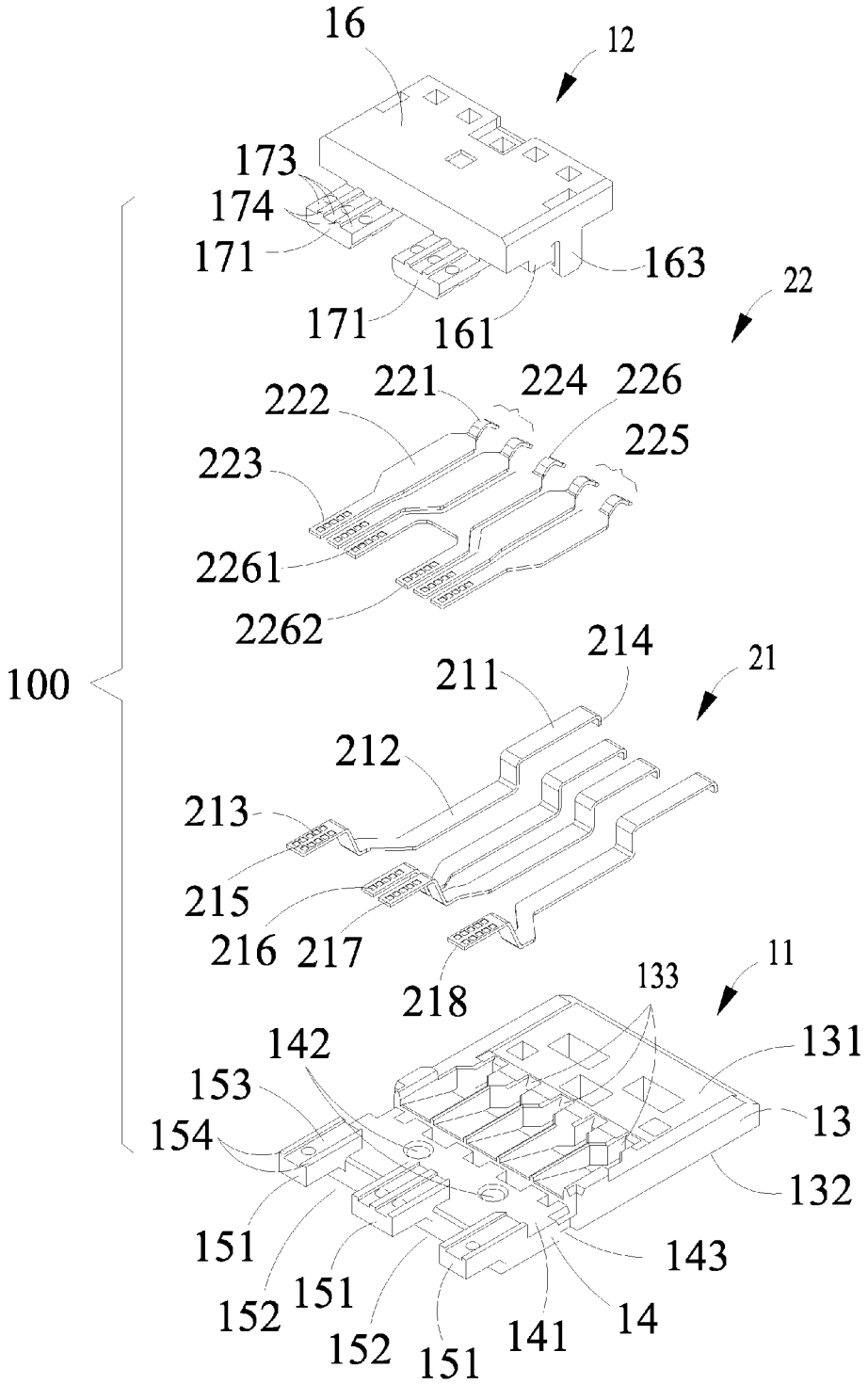
FIG. 6 is an exploded view of the electrical connector.
Figure 7:
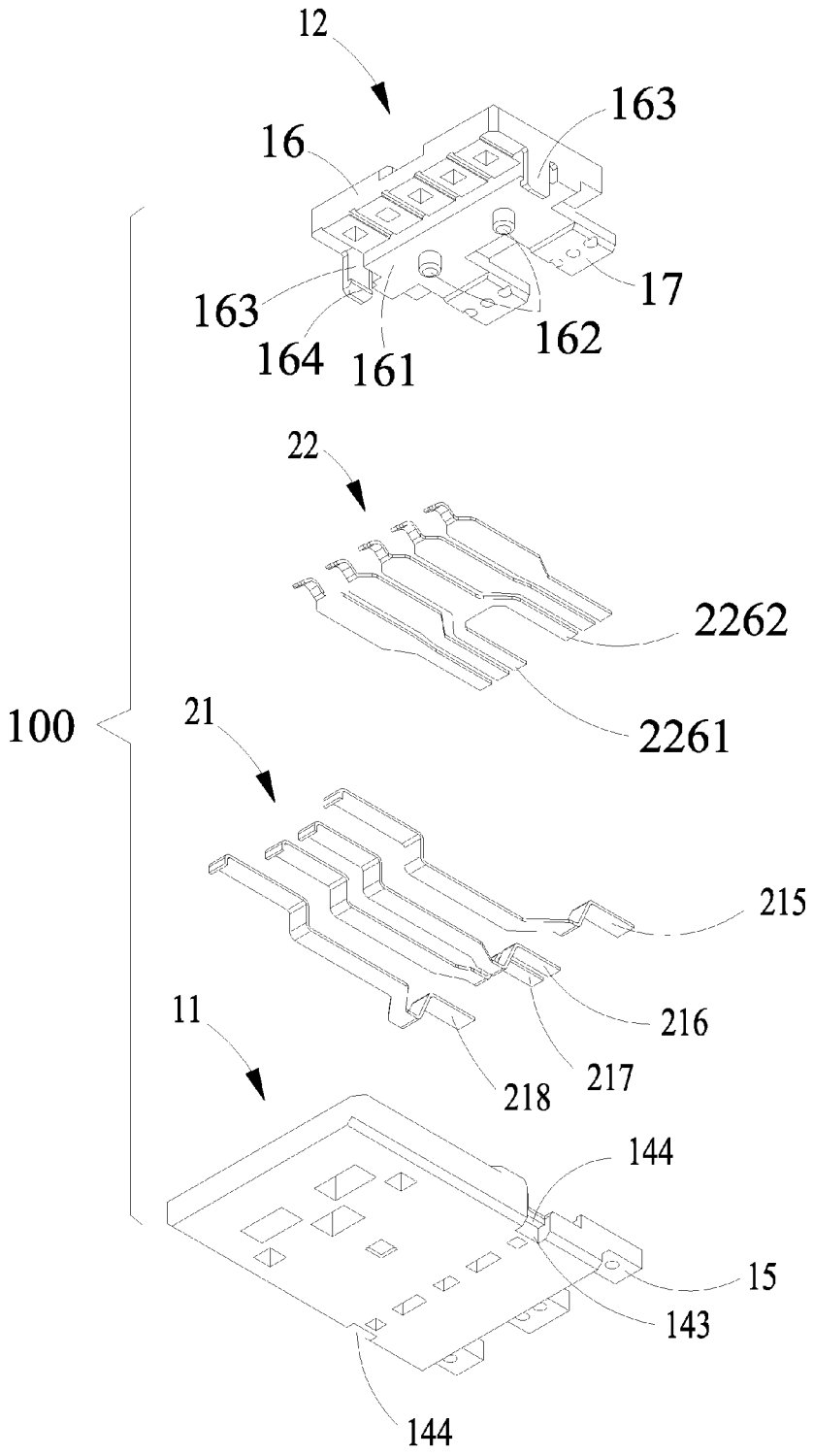
FIG. 7 is another exploded view of the electrical connector as shown in FIG. 6 while taken from a different aspect.

Referring to FIGS. 4 and 5, the insulative housing 1 includes a first housing 11 and a second housing 12 attached to the first housing 11. The first housing 11 comprises a base portion 14, a front mating portion 13 extending forwardly from the base portion 14 for mating with a mateable receptacle connector (not shown) and a first plate 15 extending backwardly from the base portion 14. The mating portion 13 is rectangular shaped and includes a top mating surface 131, a bottom surface 132 opposite to the mating surface 131 and a plurality of slots 133 extending upwardly through the mating surface 131. The base portion 14 includes a rectangular recess 141, a pair of round holes 142 formed in the recess 141, a pair of notches 143 on lateral edges thereof and a pair of stepped walls 144 exposed to the notches 143. The first plate 15 includes a plurality of first blocks 151 and a plurality of first spaces 152 between each adjacent two first blocks 151. Each first block 151 defines at least one first slot 153 and a plurality of ribs 154 beside the first slot 153.

The second housing 12 includes a main body 16 and a second plate 17 extending backwardly from the main body 16. The main body 16 includes a rectangular protrusion 161 with a pair of cylinder posts 162 thereon, and a pair of locking arms 163 each of which includes a hook 164 at a distal end thereof. The rectangular protrusion 161 is received in the recess 141 of the first housing 11 with the cylinder posts 162 inserted in the round holes 142 for positioning. The locking arms 163 extend into the notches 143 along a top-to-bottom direction with the hooks 164 locking with corresponding stepped walls 144 so as to prevent the second housing 12 from being separated from the first housing 11 along a bottom-to-top direction. The second plate 17 includes a plurality of second blocks 171 which are tightly received in the first spaces 152 of the first plate 15. In another word, the first blocks 151 and the second blocks 171 are alternately arranged side by side with each other along a width direction of the insulative housing 1. Preferably, the first plate 15 is coplanar with the second plate 17. For the following description, the first plate 15 and the second plate 17 are together called a supporting portion. Each second block 171 defines at least one second slot 173 and a plurality of ribs 174 beside the second slot 173.

Referring to FIGS. 1 and 3 to 7, the contacts 2 are divided into a first contact group and a second contact group. The first contact group includes a plurality of first contacts 21 compatible to USB 2.0 standard. From a structural viewpoint, each first contact 21 includes a flat/rigid first contacting section 211 extending onto the mating surface 131 of the mating portion 13 (as shown in FIG. 1), a first retaining section 212 fixed in the first housing 11 of the insulative housing 1 and a flat first soldering section 213. From a functional viewpoint, the first contacts 21 include a power contact 215, a first signal contact 216, a second signal contact 217 and a first grounding contact 218.

According to the illustrated embodiment of the present invention, the first contacts 21 are insert-molded with the first housing 11. The first retaining sections 212 are lower than the first contacting sections 211 and the first soldering sections 213 so that, on one hand, the first retaining sections 212 can be more stably embedded in the first housing 11; on the other hand, the first contacting sections 211 can be exposed on the mating surface 131 for mating with the mateable receptacle connector and the first soldering sections 213 can be exposed on a top surface of the first blocks 151 for being connected to cables. Besides, each first contact 21 includes a front tab 214 bent downwardly from a front edge of the first contacting section 212. The front tabs 214 are embedded in the mating portion 13 for not only securely retaining the first contacting sections 211 onto the mating surface 131 of the mating portion 13 but also preventing the first contacting sections 211 from upwardly buckling during insertion into the mateable receptacle connector. As shown in FIG. 4, the first soldering sections 213 are received in corresponding first slots 153 and separated by the ribs 154. Understandably, when the first contacts 21 are fixed in the first housing 11 through an insert molding technology, since the liquid material of the first housing 11 are ejected into a cavity of a mold so as to ultimately combine with the first contacts 21. That is to say, during manufacturing the electrical connector 100, the first slots 153 and the ribs 154 cannot be obviously observed. Anyway, when removing the first soldering sections 213 from an end product of the electrical connector 100, the first slots 153 and the ribs 154 can be seen. In an alternative embodiment, the first contacts 21 can be fixed in the first housing 11 through an assembling technology. Under this condition, once the first housing 11 is formed, the first slots 153 and the ribs 154 can be directly seen. The combination of the first contacts 21 and the first housing 11 form a contact module as shown in FIGS. 4 and 5.

Referring to FIGS. 1 and 3 to 7, the second contact group includes a plurality of second contacts 22. The first contacts 21 and the second contacts 22 jointly are compatible to USB 3.0 standard. From a structural viewpoint, each second contact 22 includes a resilient/deformable second contacting section 221, a second retaining section 222 fixed in the second housing 12 of the insulative housing 1 and a flat second soldering section 223 for being connected to a cable. From a functional viewpoint, the second contacts 22 includes a first pair of high-speed differential signal contacts 224, a second pair of high-speed differential signal contacts 225 and a second grounding contact 226 disposed between the first pair and the second pair of high-speed differential signal contacts 224, 225.

Figure 3:
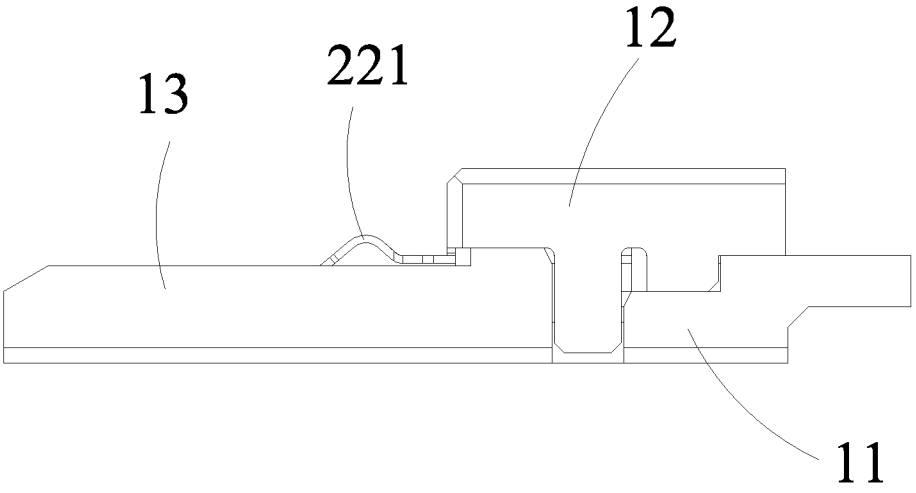
FIG. 3 is a side view of the electrical connector as shown in FIG. 1.

As shown in FIGS. 1 and 3, the resilient second contacting sections 221 protrude upwardly beyond the first contacting sections 211 and the mating surface 131 of the mating portion 13, and are deformable in corresponding slots 133 during connector mating. The first contacting sections 211 are positioned at the front of the resilient second contacting sections 221. According to the illustrated embodiment of the present invention, the second contacts 22 are insert-molded with the second housing 12 with the second soldering sections 223 exposed on a top surface of the second blocks 171 for being connected to cables. As shown in FIGS. 1 and 4, the second soldering sections 223 are received in corresponding second slots 173 and separated by the ribs 174. Understandably, when the second contacts 22 are fixed in the second housing 12 through an insert molding technology, since the liquid material of the second housing 12 are ejected into a cavity of a mold so as to ultimately combine with the second contacts 22. That is to say, during manufacturing the electrical connector 100, the second slots 173 and the ribs 174 cannot be obviously observed. Anyway, when removing the second soldering sections 223 from an end product of the electrical connector 100, the second slots 173 and the ribs 174 can be seen. In an alternative embodiment, the second contacts 22 can be fixed in the second housing 12 through an assembling technology. Under this condition, once the second housing 12 is formed, the second slots 173 and the ribs 174 can be directly seen. The combination of the second contacts 22 and the second housing 12 form another contact module as shown in FIGS. 4 and 5.

The second soldering section 223 of the second grounding contact 226 is of a forked manner and includes a first branch 2261 and a second branch 2262. The first branch 2261 and the second branch 2262 are symmetrically with each other under condition that front ends of the first branch 2261 and the second branch 2262 are connected together while rear ends of the first branch 2261 and the second branch 2262 are separated from each other. The first signal contact 216 and the second signal contact 217 constitute a differential pair. The first soldering sections 213 of the first signal contact 216 and the second signal contact 217 are positioned between the first branch 2261 and the second branch 2262 as a result that signal transmission of the first signal contact 216 and the second signal contact 217 can be greatly improved.

Figure 2:
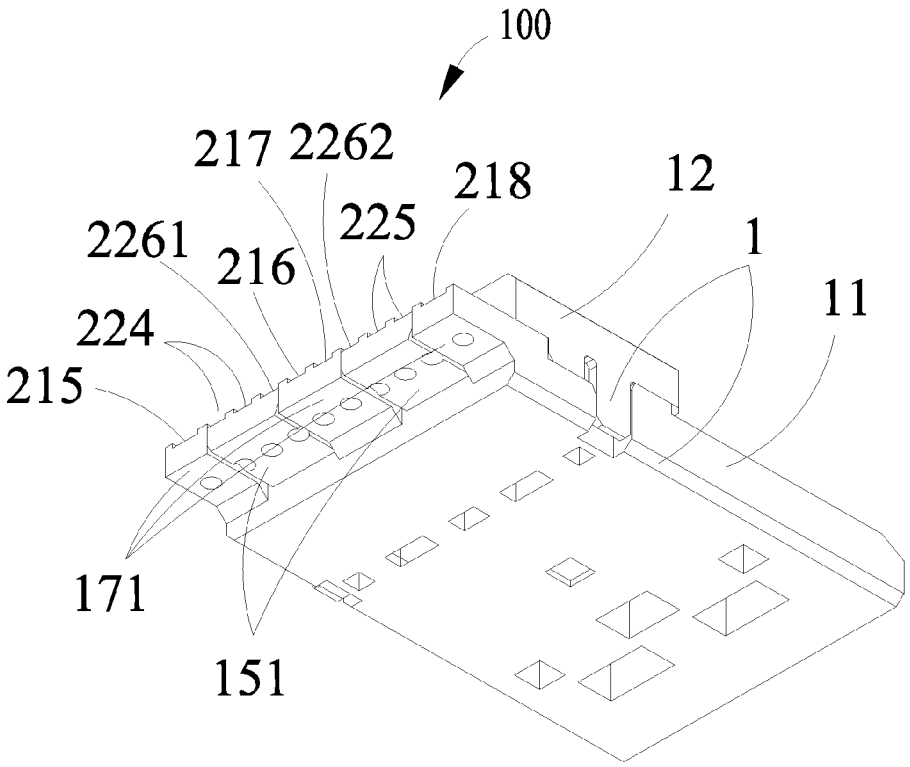
FIG. 2 is another perspective view of the electrical connector as shown in FIG. 1 while taken from a different aspect.

In assembling, as shown in FIGS. 1 to 3, the first housing 11 with the first contacts 21 and the second housing 12 with the second contacts 22 are locked with each other. The first blocks 151 and the second blocks 171 are in alignment with each other. The first soldering sections 213 and the second soldering sections 223 are supported by and exposed on a single top side of the supporting portion. As a result, cables can be easily and simultaneously soldered to the first and the second soldering sections 213, 223 for improving assembling efficiency. Preferably, the first soldering sections 213 and the second soldering sections 223 are coplanar with each other. According to the illustrated embodiment of the present invention, the flat soldering sections 213 and the second soldering sections 223 are arranged in turn as follows along a width direction of the supporting portion: the first soldering section 213 of the power contact 215, the second soldering sections 223 of the first pair of high-speed differential signal contacts 224, the first branch 2261 of the second grounding contact 226, the first soldering section 213 of the first signal contact 216, the first soldering section 213 of the second signal contact 217, the second branch 2262 of the second grounding contact 226, the second soldering sections 223 of the second pair of high-speed differential signal contacts 225, and the first soldering section 213 of the first grounding contact 218.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A plug connector compatible to type-A Universal Serial Bus (USB) 3.0 standard, comprising:

an insulative housing comprising a mating portion and a supporting portion; and a plurality of contacts retained in the insulative housing and divided into a first contact group and a second contact group, the first contact group comprising a plurality of first contacts each of which comprises a rigid first contacting section extending onto the mating portion, a first retaining section fixed in the insulative housing and a flat first soldering section, the first contacts comprising a power contact, a first signal contact, a second signal contact and a first grounding contact; the second contact group comprising a plurality of second contacts each of which comprises a resilient second contacting section protruding upwardly beyond the mating portion, a second retaining section fixed in the insulative housing and a flat second soldering section, the second contacts comprising a first pair of high-speed differential signal contacts, a second pair of high-speed differential signal contacts and a second grounding contact disposed between the first pair and the second pair of high-speed differential signal contacts; wherein the flat first soldering sections and the flat second soldering sections are supported by and exposed on a single side of the supporting portion.

2. The plug connector as claimed in claim 1, wherein the supporting portion defines a plurality of first slots to receive the flat first soldering sections and a plurality of second slots to receive the flat second soldering sections.

3. The plug connector as claimed in claim 1, wherein the supporting portion comprises a plurality of ribs to separate the flat first soldering sections and the flat second soldering sections.

4. The plug connector as claimed in claim 1, wherein the flat first soldering sections and the flat second soldering sections are coplanar with each other.

5. The plug connector as claimed in claim 1, wherein the insulative housing comprises a first housing with the mating portion formed thereon and a second housing locked with the first housing, the supporting portion comprising a first plate formed on the first housing and a second plate formed on the second housing, the first plate being coplanar with the second plate.

6. The plug connector as claimed in claim 5, wherein the first plate comprises a plurality of first blocks to support the flat first soldering sections and a plurality of first spaces between each adjacent two first blocks, and the second plate comprises a plurality of second blocks to support the flat second soldering sections, the second blocks being received in the first spaces so as to align the first blocks and the second blocks.

7. The plug connector as claimed in claim 5, wherein the first contacts and the second contacts are insert-molded with the first housing and the second housing, respectively, the second housing being locked with the first housing along a top-to-bottom direction.

8. The plug connector as claimed in claim 7, wherein the first housing comprises a pair of notches on lateral edges thereof and a pair of stepped walls exposed to the notches, the second housing comprising a pair of locking arms each of which comprises a hook to lock with corresponding stepped wall so as to prevent the second housing from being separated from the first housing along a bottom-to-top direction.

9. The plug connector as claimed in claim 8, wherein the first housing defines a pair of holes and the second housing comprises a pair of cylinder posts inserted in the holes for positioning.

10. The plug connector as claimed in claim 9, wherein the first housing defines a recess with the pair of holes therein and the second housing comprises a protrusion with the pair of cylinder posts thereon, the protrusion being received in the recess.

11. The plug connector as claimed in claim 6, wherein the flat second soldering section of the second grounding contact is of a forked manner and comprises a first branch and a second branch in condition that front ends of the first branch and the second branch are connected together while rear ends of the first branch and the second branch are separated from each other, the flat first soldering sections of the first signal contact and the second signal contact being positioned between the first branch and the second branch.

12. The plug connector as claimed in claim 11, wherein the flat first soldering sections and the flat second soldering sections are arranged in turn as follows along a width direction of the supporting portion: the flat first soldering section of the power contact, the flat second soldering sections of the first pair of high-speed differential signal contacts, the first branch of the second grounding contact, the flat first soldering section of the first signal contact, the flat first soldering section of the second signal contact, the second branch of the second grounding contact, the flat second soldering sections of the second pair of high-speed differential signal contacts, and the flat first soldering section of the first grounding contact.

13. An electrical connector comprising:

an insulative housing comprising a first housing and a second housing fixed to the first housing, the first housing comprising a mating portion and a plurality of first blocks, the second housing defining a plurality of second blocks;

a plurality of first contacts retained in the first housing, each first contact comprising a flat first contacting section exposed on the mating portion, a first retaining section fixed to the first housing and a first soldering section supported by corresponding first block, the first contacts being compatible to USB 2.0 standard; and a plurality of second contacts retained in the second housing, each second contact comprising a resilient second contacting section protruding upwardly beyond and located behind the first contacting sections, a second retaining section fixed to the second housing and a second soldering section supported by corresponding second block, the first contacts and the second contacts jointly being compatible to USB 3.0 standard, the second contacts comprising a first pair of high-speed differential signal contacts, a second pair of high-speed differential signal contacts and a grounding contact disposed between the first pair and the second pair of high-speed differential signal contacts; wherein the first blocks and the second blocks are alternately arranged side by side with the first soldering sections and the second soldering sections exposed on a single top side of the insulative housing.

14. The electrical connector as claimed in claim 13, wherein each first block comprises at least one first slot to receive corresponding flat first soldering section, and each second block comprises at least one second slot to receive corresponding flat second soldering section.

15. The electrical connector as claimed in claim 13, wherein the flat first soldering sections and the flat second soldering sections are coplanar with each other.

16. The electrical connector as claimed in claim 13, wherein the first housing comprises a plurality of first spaces between each adjacent two first blocks to tightly receive the second blocks.

17. The electrical connector as claimed in claim 13, wherein the first contacts and the second contacts are insert-molded with the first housing and the second housing, respectively, the second housing being locked with the first housing along a top-to-bottom direction.

18. The electrical connector as claimed in claim 17, wherein the first housing comprises a pair of notches on lateral edges thereof and a pair of stepped walls exposed to the notches, the second housing comprising a pair of locking arms each of which comprises a hook to lock with corresponding stepped wall so as to prevent the second housing from being separated from the first housing along a bottom-to-top direction.

19. The electrical connector as claimed in claim 18, wherein the first housing defines a pair of holes and the second housing comprises a pair of cylinder posts inserted in the holes for positioning.

20. The electrical connector as claimed in claim 19, wherein the first housing defines a recess with the pair of holes therein and the second housing comprises a protrusion with the pair of cylinder posts thereon, the protrusion being received in the recess.

* * * * *